US009134653B2

(12) United States Patent
Watanabe

(10) Patent No.: US 9,134,653 B2
(45) Date of Patent: Sep. 15, 2015

(54) IMAGE FORMING APPARATUS WITH A TONER COLLECTION MODE THAT COLLECTS TONER DROPPED ON A RESTRICTION BLADE FROM A DEVELOPMENT ROLLER

(71) Applicant: KYOCERA Document Solutions Inc., Osaka (JP)

(72) Inventor: Akihiro Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/279,166

(22) Filed: May 15, 2014

(65) Prior Publication Data

US 2014/0376973 A1 Dec. 25, 2014

(30) Foreign Application Priority Data

Jun. 21, 2013 (JP) ..... 2013-130720

(51) Int. Cl.

| | |
|---|---|
| ***G03G 15/09*** | (2006.01) |
| ***G03G 15/095*** | (2006.01) |
| ***G03G 13/095*** | (2006.01) |
| *G03G 15/08* | (2006.01) |

(52) U.S. Cl.

CPC ..... *G03G 15/0907* (2013.01); *G03G 13/095* (2013.01); *G03G 15/095* (2013.01); *G03G 15/0812* (2013.01)

(58) Field of Classification Search

CPC . G03G 15/0907; G03G 15/095; G03G 13/09; G03G 13/095; G03G 21/0047

See application file for complete search history.

(56) References Cited

U.S. PATENT DOCUMENTS

| | | | | |
|---|---|---|---|---|
| 5,897,243 | A * | 4/1999 | Komatsubara et al. | 399/98 |
| 6,353,720 | B1 * | 3/2002 | Sakai et al. | 399/234 |
| 2013/0216251 | A1 * | 8/2013 | Watanabe | 399/53 |
| 2013/0272751 | A1 * | 10/2013 | Eiki | 399/273 |

FOREIGN PATENT DOCUMENTS

JP 2009-258276 A 11/2009

* cited by examiner

*Primary Examiner* — Clayton E. Laballe
*Assistant Examiner* — Peter L Cheng
(74) *Attorney, Agent, or Firm* — Stein IP, LLC

(57) ABSTRACT

When image formation is not performed, an image forming apparatus performs a toner collection mode that includes a first positive rotation step of rotating a developer carrying member and a toner carrying member in the same direction as a direction at the time of image formation, in a state where a second bias applied to the toner carrying member is set at a higher voltage on the same polarity side as a toner than a first bias, and a reverse rotation step of rotating the developer carrying member and the toner carrying member in a direction reverse to the direction at the time of image formation after the first positive rotation step is performed, in a state where the first bias is set at a higher voltage on the same polarity side as the toner than the second bias.

7 Claims, 5 Drawing Sheets

IMAGE FORMING APPARATUS WITH A TONER COLLECTION MODE THAT COLLECTS TONER DROPPED ON A RESTRICTION BLADE FROM A DEVELOPMENT ROLLER

CROSS-REFERENCE TO RELATED APPLICATIONS

This application is based upon and claims the benefit of priority from the corresponding Japanese Patent Application No. 2013-130720, filed on Jun. 21, 2013, the entire contents of which are incorporated herein by reference.

BACKGROUND OF THE INVENTION

The present disclosure relates to an image forming apparatus such as a copying machine, a printer, a facsimile machine or their multifunctional machine, and more particularly relates to an image forming apparatus that includes a development device which uses a two-component developer containing a toner and a magnetic carrier and which carries only the toner on a toner carrying member to develop an electrostatic latent image on an image carrying member.

Conventionally, as a development device that develops an electrostatic latent image on a photosensitive drum which is an image carrying member, the development devices of a one-component development method and a two-component development method are known. The two-component development method is suitable for achieving a long life because a developer formed with a toner and a magnetic carrier is used to stabilize the amount of charge for a long period of time. For example, the development device of the two-component development method holds a two-component developer containing a toner and a magnetic carrier, and supplies the developer from an agitation member to a magnetic roller (developer carrying member). The magnetic roller includes a magnet therewithin, and carries, with the magnet, the developer as a magnetic brush on the surface of the magnetic roller and transports the developer to the photosensitive drum by the rotation of the magnetic roller. Furthermore, the development device includes a restriction member which restricts the thickness of the layer of the developer so that the amount of developer transported by the rotation of the magnetic roller to the photosensitive drum is made constant. When the magnetic roller is opposite the photosensitive drum, only the toner of the developer carried on the magnetic roller is supplied to the photosensitive drum, and an electrostatic latent image on the photosensitive drum is visualized as a toner image.

When the restriction member restricts the thickness of the layer of the developer to form the uniform layer of the developer on the surface of the magnetic roller, the toner in the developer is scattered, as minute particles, around the restriction member when scrubbed with the restriction member. The scattered toner is adhered to the surface of the restriction member on the downstream side with respect to the direction of rotation of the magnetic roller, and is gradually deposited.

Hence, a method is known in which in order for the toner deposit adhered to the restriction member to be scrubbed off, a bias between a photosensitive drum and a magnetic roller is turned off, the rotation of the photosensitive drum is stopped and furthermore, the magnetic roller is rotated in a reverse direction to that at the time of image formation.

Incidentally, as a two-component development method other than the development method described above, a development method is known which includes a magnetic roller (developer carrying member) that carries, with a magnet incorporated, a developer containing a toner and a magnetic carrier on its surface as a magnetic brush to transport the carried magnetic brush, a development roller (toner carrying member) that is arranged opposite a photosensitive drum and the magnetic roller, that carries the toner in the magnetic brush transported by the magnetic roller on the surface and that supplies the carried toner to the photosensitive drum and a restriction member that is arranged a predetermined distance apart from the magnetic roller and that restricts the thickness of the layer of the developer on the surface of the magnetic roller, and which carries only the toner on the development roller to develop an electrostatic latent image on the photosensitive drum.

SUMMARY OF THE INVENTION

According to one aspect of the present disclosure, there is provided an image forming apparatus including an image carrying member, a development device, a first voltage application portion, a second voltage application portion and a control portion. On the image carrying member, an electrostatic latent image is formed. The development device includes a developer carrying member, a toner carrying member and a restriction member, and develops the electrostatic latent image formed on the surface of the image carrying member into a toner image. The developer carrying member carries, with a magnet incorporated, as a magnetic brush, on the surface, a two-component developer containing a toner and a magnetic carrier and transports the carried magnetic brush by rotation. The toner carrying member is arranged opposite the image carrying member and the developer carrying member, carries, on the surface, the toner in the magnetic brush transported by the rotation of the developer carrying member and supplies the carried toner to the image carrying member. The restriction member is arranged a predetermined distance apart from the developer carrying member below the toner carrying member and restricts the thickness of a layer of the developer on the surface of the developer carrying member. The first voltage application portion applies a first bias to the developer carrying member. The second voltage application portion applies a second bias to the toner carrying member. The control portion controls voltages of the first voltage application portion and the second voltage application portion and drive and rotation of the developer carrying member and the toner carrying member. The control portion can perform, at a time of no image formation, a toner collection mode that includes a first positive rotation step in which in a state where the second bias is set at a higher voltage on a same polarity side as the toner than the first bias, the developer carrying member and the toner carrying member are rotated in a same direction as a direction at a time of image formation and a reverse rotation step in which after the first positive rotation step is performed, in a state where the first bias is set at a higher voltage on the same polarity side as the toner than the second bias, the developer carrying member and the toner carrying member are rotated in a reverse direction to the direction at the time of image formation.

Further other objects and specific advantages of the present disclosure will become further apparent from the description of an embodiment discussed below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
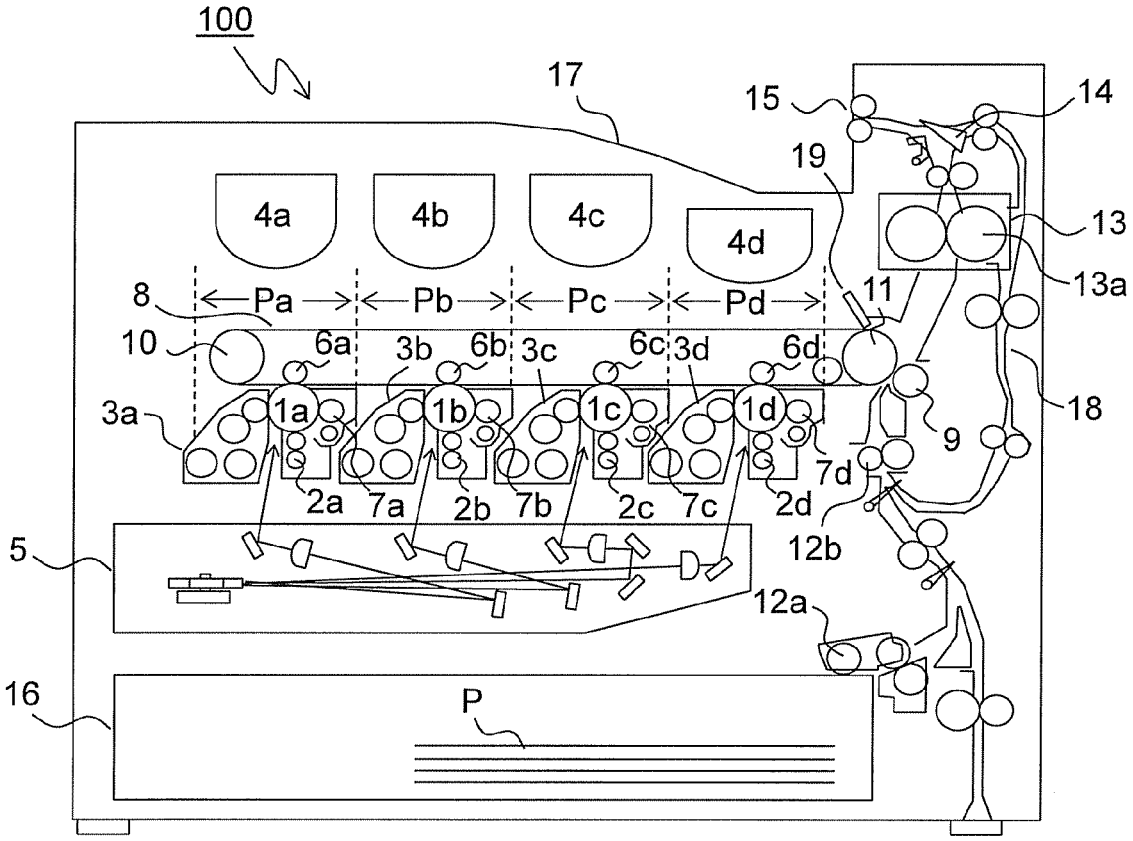
FIG. 1 is a schematic cross-sectional view showing an image forming apparatus 100 according to an embodiment of the present disclosure.

An embodiment of the present disclosure will be described below with reference to accompanying drawings. FIG. 1 is a cross-sectional view showing a schematic configuration of an image forming apparatus 100 including development devices 3*a* to 3*d* according to the embodiment of the present disclosure. In the present embodiment, the image forming apparatus 100 is formed with a quadruplicate tandem-type color printer in which four photosensitive drums 1*a*, 1*b*, 1*c* and 1*d* corresponding to four different colors (magenta, cyan, yellow and black) are arranged parallel to perform image formation.

Within the main body of the image forming apparatus 100, four image formation portions Pa, Pb, Pc and Pd are sequentially arranged from the left side in FIG. 1. These image formation portions Pa to Pd are provided according to images of the four different colors (magenta, cyan, yellow and black), and the individual images of magenta, cyan, yellow and black are formed sequentially in the steps of charging, exposure, development and transfer.

In these image formation portions Pa to Pd, the above-described photosensitive drums 1*a* to 1*d* which carry visual images (toner images) of the individual colors are respectively provided. Furthermore, an intermediate transfer belt 8 that is rotated in a counterclockwise direction in FIG. 1 is provided adjacent to the image formation portions Pa to Pd. The toner images formed on these photosensitive drums 1*a* to 1*d* are sequentially transferred onto the intermediate transfer belt 8 that is moved in contact with the photosensitive drums 1*a* to 1*d*, are thereafter transferred with a secondary transfer roller 9 onto a sheet P at one time and are further fixed on the sheet P in a fixing device 13 and the sheet P is then ejected from the image forming apparatus 100. While the photosensitive drums 1*a* to 1*d* are being rotated in a clockwise direction in FIG. 1, an image formation process is performed on the photosensitive drums 1*a* to 1*d*.

The sheet P to which the toner image is transferred is stored in a sheet cassette 16 arranged in a lower portion of the image forming apparatus 100, and is transported through a paper feed roller 12*a* and a registration roller pair 12*b* to the secondary transfer roller 9. As the intermediate transfer belt 8, a sheet of dielectric resin is used, and a seamless belt is mainly used. The intermediate transfer belt 8 and the secondary transfer roller 9 are driven to rotate by a belt drive motor (not shown) at the same linear speed as the photosensitive drums 1*a* to 1*d*. On the downstream side of the secondary transfer roller 9, a blade-shaped belt cleaner 19 for removing the toner and the like left on the surface of the intermediate transfer belt 8 is arranged.

The image formation portions Pa to Pd will now be described. Around and below the photosensitive drums 1*a* to 1*d*, which are rotatably arranged, are provided charging devices 2*a*, 2*b*, 2*c* and 2*d* that charge the photosensitive drums 1*a* to 1*d*, an exposure unit 5 that performs exposure based on image data to the photosensitive drums 1*a* to 1*d*, development devices 3*a*, 3*b*, 3*c* and 3*d* that develop, with toner, electrostatic latent images formed on the photosensitive drums 1*a* to 1*d* and cleaning devices 7*a*, 7*b*, 7*c* and 7*d* that collect and remove a developer (toner) left after the transfer of the toner images on the photosensitive drums 1*a* to 1*d*.

When the image data is input from a higher-level device such as a personal computer, the charging devices 2*a* to 2*d* first uniformly charge the surfaces of the photosensitive drums 1*a* to 1*d*, then the exposure unit 5 applies light based on the image data and electrostatic latent images corresponding to the image data are formed on the individual photosensitive drums 1*a* to 1*d*. The development devices 3*a* to 3*d* include development rollers (toner carrying members) arranged opposite the photosensitive drums 1*a* to 1*d*, and a predetermined amount of two-component developer containing the toner of each of the colors, that is, magenta, cyan, yellow and black is put into the development devices 3*a* to 3*d*, respectively.

When a proportion of the toner in the two-component developer with which the development devices 3*a* to 3*d* are filled becomes lower than a specified value by the formation of the toner image which will be described later, the toner is fed from toner containers 4*a* to 4*d* to the development devices 3*a* to 3*d*. The toner is supplied by the development devices 3*a* to 3*d* onto the photosensitive drums 1*a* to 1*d*, and is electrostatically adhered thereto, with the result that the toner image corresponding to the electrostatic latent image formed through the exposure by the exposure unit 5 is formed.

Then, a predetermined transfer voltage is applied by primary transfer rollers 6*a* to 6*d* between the primary transfer rollers 6*a* to 6*d* and the photosensitive drums 1*a* to 1*d*, and thus the toner images of magenta, cyan, yellow and black on the photosensitive drums 1*a* to 1*d* are primarily transferred onto the intermediate transfer belt 8. These images of the four colors are formed to have a predetermined positional relationship such that a predetermined full-color image is formed. The primary transfer rollers 6*a* to 6*d* are driven to rotate by a primary transfer drive motor (not shown) at the same linear speed as the photosensitive drums 1*a* to 1*d* and the intermediate transfer belt 8. Thereafter, in order for the subsequent formation of a new electrostatic latent image to be prepared, the toner left on the surfaces of the photosensitive drums 1*a* to 1*d* is removed by the cleaning devices 7*a* to 7*d*.

The intermediate transfer belt 8 is placed over a driven roller 10 and a drive roller 11; when the intermediate transfer belt 8 starts to be rotated in a counterclockwise direction as the drive roller 11 is rotated by the belt drive motor described above, the sheet P is transported from the registration roller pair 12*b* with predetermined timing to a nip portion (secondary transfer nip portion) between the secondary transfer roller 9 provided adjacent to the intermediate transfer belt 8 and the intermediate transfer belt 8, with the result that the full-color image is secondarily transferred onto the sheet P in the nip portion. The sheet P to which the toner image has been transferred is transported to the fixing device 13.

When the sheet P transported to the fixing device 13 passes through a nip portion (fixing nip portion) of a fixing roller pair 13*a*, the sheet P is heated and pressurized, and thus the toner image is fixed to the surface of the sheet P, with the result that the predetermined full-color image is formed. The sheet P on which the full-color image is formed is selectively transported, by a branch portion 14 branching into a plurality of directions, in a particular direction. When an image is formed on only one surface of the sheet P, the sheet P is ejected by an ejection roller pair 15 into an ejection tray 17 without being processed.

On the other hand, when images are formed on both surfaces of the sheet P, part of the sheet P passing through the fixing device 13 is temporarily protruded from the ejection roller pair 15 to the outside of the apparatus. Thereafter, the sheet P is selectively transported at the branch portion 14 by the reverse rotation of the ejection roller pair 15 to a reverse transport path 18, and with the surface of the image reversed, the sheet P is transported again to the secondary transfer roller 9. Then, the subsequent image formed on the intermediate transfer belt 8 is transferred by the secondary transfer roller 9 to the surface on which no image is formed on the sheet P and is transported to the fixing device 13 where the toner image is fixed and the sheet P is thereafter ejected into the ejection tray 17 by the ejection roller pair 15.

Figure 2:
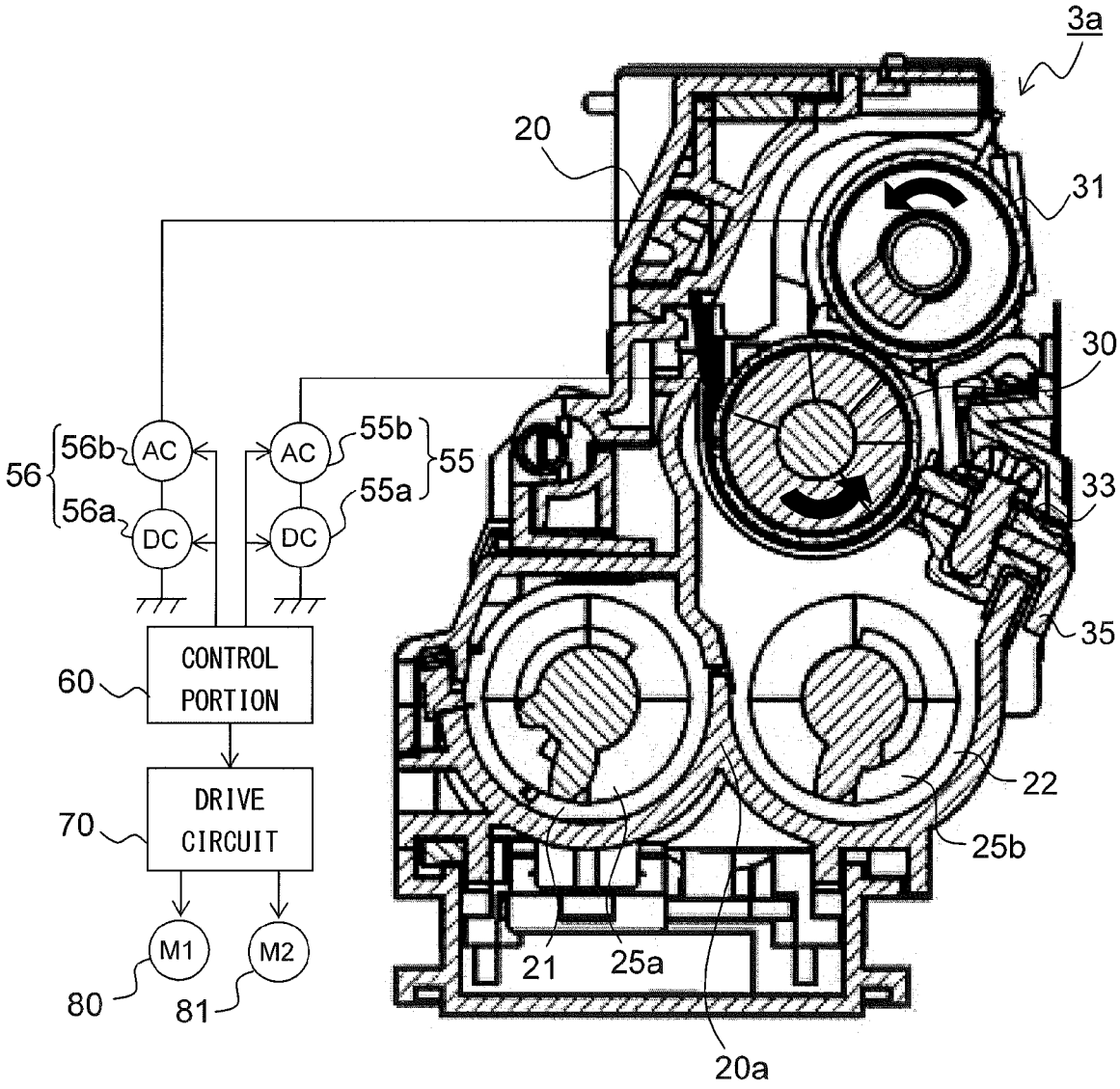
FIG. 2 is a side cross-sectional view of a development device 3*a* incorporated in the image forming apparatus 100.

FIG. 2 is a schematic side cross-sectional view of the development device 3*a*. Although in the following description, the configuration and the operation of the development device 3*a* arranged in the image formation portion Pa of FIG. 1 will be discussed, since the configuration and the operation of the development devices 3*b* to 3*d* arranged in the image formation portions Pb to Pd are basically the same, their description will be omitted.

As shown in FIG. 2, the development device 3*a* includes a development container (housing) 20 in which the two-component developer (hereinafter simply referred to as the developer) containing the toner and a magnetic carrier is stored, and the development container 20 is partitioned by a partition wall 20*a* into an agitation transport chamber 21 and a supply transport chamber 22. In the agitation transport chamber 21 and the supply transport chamber 22, an agitation transport screw 25*a* and a supply transport screw 25*b* for mixing the toner (positively charged toner) supplied from the toner container 4*a* (see FIG. 1) with the carrier, and agitating and charging it are respectively arranged such that they can be individually rotated.

The developer is transported in the direction of a shaft (the direction perpendicular to the plane of FIG. 2) while being agitated by the agitation transport screw 25*a* and the supply transport screw 25*b*, and is circulated between the agitation transport chamber 21 and the supply transport chamber 22 through unillustrated developer passages formed at both end portions of the partition wall 20*a*. In other words, the agitation transport chamber 21, the supply transport chamber 22 and the developer passages form the circulation path of the developer within the development container 20.

The development container 20 extends diagonally upwardly to the right in FIG. 2, a magnetic roller 30 is arranged above the supply transport screw 25*b* within the development container 20 and a development roller 31 is arranged diagonally upwardly to the right with respect to the magnetic roller 30 so as to be opposite the magnetic roller 30. The development roller 31 is opposite the photosensitive drum 1*a* (see FIG. 1) on the opening side (the right side of FIG. 2) of the development container 20. The magnetic roller 30 and the development roller 31 are individually rotated in the counterclockwise direction of FIG. 2 about the rotation shafts thereof at the time of image formation.

In the agitation transport chamber 21, an unillustrated toner concentration sensor is arranged opposite the agitation transport screw 25*a*, and based on the result of detection of the toner concentration sensor, the toner is fed from the toner container 4*a* through an unillustrated toner feed port to the agitation transport chamber 21. As the toner concentration sensor, for example, a magnetic permeability sensor is used that detects the magnetic permeability of the two-component developer formed with the toner and the magnetic carrier within the development container 20.

The magnetic roller 30 is formed with a cylindrical rotation sleeve formed of a non-magnetic material and a stationary magnet member having a plurality of magnetic poles incorporated in the rotation sleeve. The stationary magnet member is formed with a plurality of magnets the peripheral portions of which have different polarities, and has a main pole opposite the development roller 31, a restriction pole (ear cutting magnetic pole) opposite a restriction blade 33, a transport pole, a separation pole, a pumping-up pole and the like. The stationary magnet member is fixed and adhered to the rotation shaft of the magnetic roller 30 which is supported to the development container 20 such that the rotation shaft cannot be rotated.

The rotation sleeve is arranged a predetermined distance apart from the stationary magnet member, and thereby carries the developer as the magnetic brush on the surface of the rotation sleeve. The rotation sleeve is rotatably supported to the development container 20, and is rotated in the direction of an arrow (counterclockwise direction) by a drive mechanism formed with a development motor 81 and an unillustrated gearwheel to transport the magnetic brush. A first bias obtained by superimposing an alternating-current voltage (hereinafter referred to as a Vmag (AC)) on a direct-current voltage (hereinafter referred to as a Vmag (DC)) is applied to the rotation sleeve by a first voltage application portion 55 formed with a direct-current power supply 55*a* and an alternating-current power supply 55*b*.

The development roller 31 is formed with a cylindrical development sleeve formed of a non-magnetic material and a development roller side magnetic pole fixed within the development sleeve. The magnetic roller 30 and the development roller 31 are opposite each other in face-to-face positions (opposite positions) with a predetermined gap therebetween. The development roller side magnetic pole has a different polarity from the opposite magnetic pole (main pole) of the stationary magnet member.

The development roller side magnetic pole is a predetermined distance apart from the development sleeve, and is fixed and adhered to the rotation shaft of the development roller 31 in the position opposite the magnetic roller 30. The rotation shaft of the development roller 31 is supported to the development container 20 such that the rotation shaft of the development roller 31 cannot be rotated. The development sleeve is opposite the photosensitive drum 1*a*, is arranged a predetermined distance apart on the left side of the photosensitive drum 1*a* in FIG. 1 and forms a development region for supplying the toner to the photosensitive drum 1*a* in the opposite position close to the photosensitive drum 1*a*. The development sleeve is rotatably supported to the development container 20, and is rotated in the same direction (counterclockwise direction) as the rotation sleeve by a drive mechanism formed with the development motor 81 and an unillustrated gearwheel. A second bias obtained by superimposing an alternating-current voltage (hereinafter referred to as a Vslv (AC)) on a direct-current voltage (hereinafter referred to as a Vslv (DC)) is applied to the development sleeve by a second voltage application portion 56 formed with a direct-current power supply 56a and an alternating-current power supply 56*b*.

The restriction blade (ear cutting blade) 33 is attached to the development container 20 along the longitudinal direction (direction perpendicular to the plane of FIG. 2) of the magnetic roller 30. The restriction blade 33 is formed of a magnetic material such as a stainless steel in the shape of a plate, is securely fixed, with a blade fixing screw, to a blade support stay 35 fitted to the development container 20 and is located, in the direction of rotation of the magnetic roller 30 (counterclockwise direction of FIG. 2) on the upstream side with respect to the opposite position of the development roller 31 and the magnetic roller 30. Between the tip end portion of the restriction blade 33 and the surface of the magnetic roller 30, a slight spacing (gap) is formed.

As described previously, the developer is circulated through the agitation transport chamber 21 and the supply transport chamber 22 within the development container 20 while being agitated by the agitation transport screw 25*a* and the supply transport screw 25*b*, and thus the toner in the developer is charged (here, positively charged). The developer within the supply transport chamber 22 is transported by the supply transport screw 25*b* to the magnetic roller 30. Then, the magnetic brush (not shown) is formed on the magnetic roller 30. After the thickness of the layer of the magnetic brush on the magnetic roller 30 is restricted by the restriction blade 33, the magnetic brush is transported to the opposite region of the magnetic roller 30 and the development roller 31. A toner layer is formed on the development roller 31 by a potential difference ΔV between Vmag (DC) applied to the magnetic roller 30 and Vslv (DC) applied to the development roller 31 and a magnetic field.

Although the thickness of the toner layer on the development roller 31 is varied by the resistance of the developer, a difference in the rotational speed between the magnetic roller 30 and the development roller 31 or the like, it is possible to control it with ΔV. As ΔV is increased, the thickness of the toner layer on the development roller 31 is increased whereas as ΔV is decreased, the thickness is reduced. As the range of ΔV at the time of the development, a range of about 100 V to 350 V is generally appropriate.

The toner layer formed on the development roller 31 by contact with the magnetic brush on the magnetic roller 30 is transported by the rotation of the development roller 31 to the opposite region of the photosensitive drum 1*a* and the development roller 31. Since Vslv (DC) and Vslv (AC) are applied to the development roller 31, the toner flies from the development roller 31 to the photosensitive drum 1*a* by the potential difference with the photosensitive drum 1*a*, and the electrostatic latent image on the photosensitive drum 1*a* is developed.

The toner left without being used for the development is transported to the opposite portion of the development roller 31 and the magnetic roller 30, and is collected by the magnetic brush on the magnetic roller 30. Then, the magnetic brush is pulled off from the magnetic roller 30 by the portion of the stationary magnet member having the same polarity, and is then dropped into the supply transport chamber 22.

Thereafter, based on the result of the detection of the toner concentration sensor (not shown), a predetermined amount of toner is fed into the development container 20 through the toner feed port (not shown), and while the toner is being circulated through the supply transport chamber 22 and the agitation transport chamber 21, the toner becomes the two-component developer again that has an appropriate toner concentration and that is uniformly charged. This developer is supplied again on the magnetic roller 30 by the supply transport screw 25*b* to form the magnetic brush, and the magnetic brush is transported to the restriction blade 33.

When in a print mode as described above, the toner is supplied from the development roller 31 to the photosensitive drum 1*a*, part of the toner supplied from the development roller 31 is not used for the development of the electrostatic latent image and is dropped and deposited on the restriction blade 33. This toner deposit is separated from the restriction blade 33, is carried by the magnetic roller 30, is adhered to the photosensitive drum 1*a* and is finally transferred to a recording medium, with the result that an image failure occurs. Hence, in the image forming apparatus 100 of the present embodiment, it is possible to perform a toner collection mode in which the toner dropped from the development roller 31 on the restriction blade 33 is collected to the agitation portion (the supply transport chamber 22). The toner collection mode is performed at the time of no image formation, for example, per predetermined number of sheets printed or is performed when the image forming apparatus 100 is subjected to maintenance check.

The toner collection mode is performed by a control unit that includes a control portion 60 and a drive circuit 70. The control portion 60 is formed with a microcomputer, the storage element of a RAM and a ROM and the like, switches between the print mode and the toner collection mode according to a program and data set in the storage element, controls the biases of the first voltage application portion 55 and the second voltage application portion 56 and controls the drive circuit 70 that drives a drum motor 80 and the development motor 81.

The drive circuit 70 is formed with, for example, a bridge circuit that applies a pulse voltage to the drum motor 80 and the development motor 81 formed with a DC motor, drives and rotates the drum motor 80 and the development motor 81 by applying the pulse voltage, further switches a switch within the bridge circuit to switch the direction of rotation of the development motor 81. The control portion 60 sends a positive direction signal or a reverse direction signal to the drive circuit 70. The drive circuit 70 drives and rotates the drum motor 80 such that the photosensitive drum 1*a* is rotated in the clockwise direction of FIG. 1, and drives and rotates, based on the positive direction signal, the development motor 81 such that the magnetic roller 30 and the development roller 31 are rotated in the positive direction (the counterclockwise direction of FIG. 2). On the other hand, when the drive circuit 70 receives the reverse direction signal, the drive circuit 70 drives and rotates the development motor 81 such that the magnetic roller 30 and the development roller 31 are rotated in the reverse direction (the clockwise direction of FIG. 2). The drive circuit 70 varies the width of the pulse voltage applied to the development motor 81 to vary the rotation speed of the development motor 81.

As the drive mechanism between the drum motor 80 and the photosensitive drum 1*a*, an unillustrated one-way clutch is used; even if the drum motor 80 is driven and rotated by the reverse direction signal received by the drive circuit 70, the photosensitive drum 1*a* is prevented from being rotated by the one-way clutch. As the drum motor 80 and the development motor 81, instead of DC motors, stepping motors may be used to switch the positive and reverse rotation directions.

Figure 3:
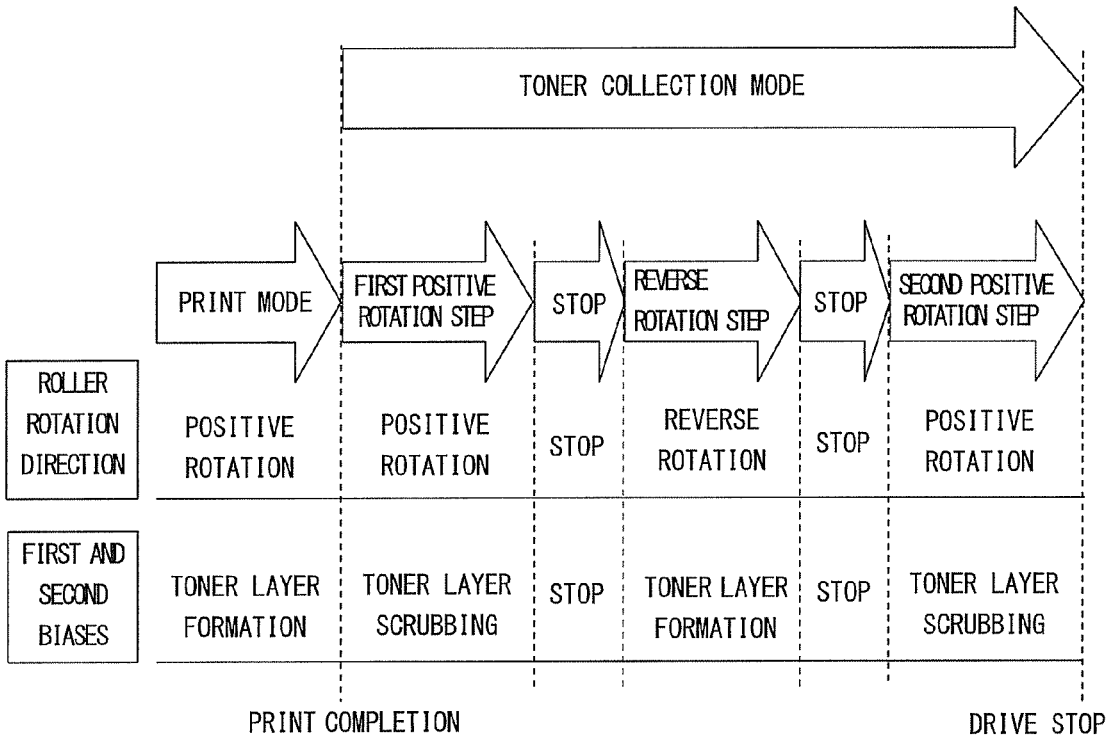
FIG. 3 is a timing chart showing, in a toner collection mode performed by the image forming apparatus 100 of the present disclosure, the rotation direction of a magnetic roller 30 and timing at which a development bias is applied.

FIG. 3 is a timing chart showing, in the toner collection mode, the rotation direction of the magnetic roller 30 and timing at which a development bias is applied; FIGS. 4 to 7 are partially enlarged views showing the vicinity of the magnetic roller 30, the development roller 31 and the restriction blade 33 in the development device 3*a*, and show the rotation direction of the magnetic roller 30 and the development roller 31 and the movement of the toner in the steps of the toner collection mode. The specific procedure to be performed in the toner collection mode will be described using FIG. 3 with reference to FIGS. 2 and 4 to 7.

Figure 4:
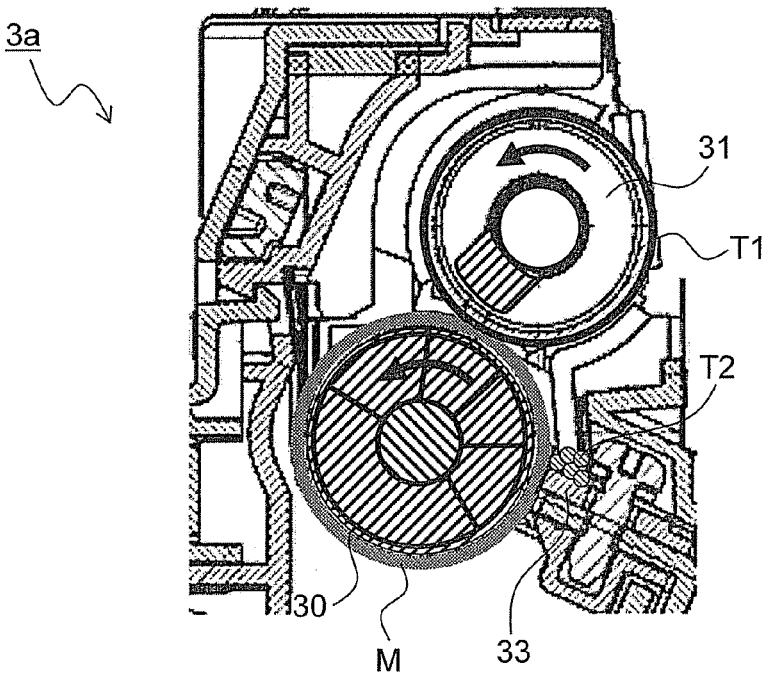
FIG. 4 is a partially enlarged view of the development device 3*a* showing a state where the magnetic roller 30 and a development roller 31 are driven in a print mode.

In the print mode, the magnetic roller 30 and the development roller 31 are rotated positively in a state where a first bias and a second bias are applied such that the toner layer is formed on the development roller 31. Specifically, the first bias of the first voltage application portion 55 is set at a higher voltage on the same polarity side (the positive side) as the toner than the second bias of the second voltage application portion 56. FIG. 4 shows a state where the magnetic roller 30 and the development roller 31 are driven in the print mode, and the magnetic roller 30 and the development roller 31 are rotated positively (rotated in the counterclockwise direction) in a state where that the magnetic brush M (displayed as a hatched ring) is formed on the magnetic roller 30 and a toner layer T1 (displayed as a solid line in the shape of a ring).

The toner collection mode includes a first positive rotation step, a reverse rotation step and a second positive rotation step. In the first positive rotation step, after the completion of a print operation, the magnetic roller 30 and the development roller 31 are rotated positively in a state where the first bias and the second bias for scrubbing the toner layer from the development roller 31 are applied. Specifically, the second bias of the second voltage application portion 56 is set at a higher voltage on the same polarity side (the positive side) as the toner than the first bias of the first voltage application portion 55. Then, the control portion 60 sends the positive direction signal to the drive circuit 70, and the drum motor 80 and the development motor 81 are rotated by the positive rotation signal in the positive direction as in the print mode.

Figure 5:
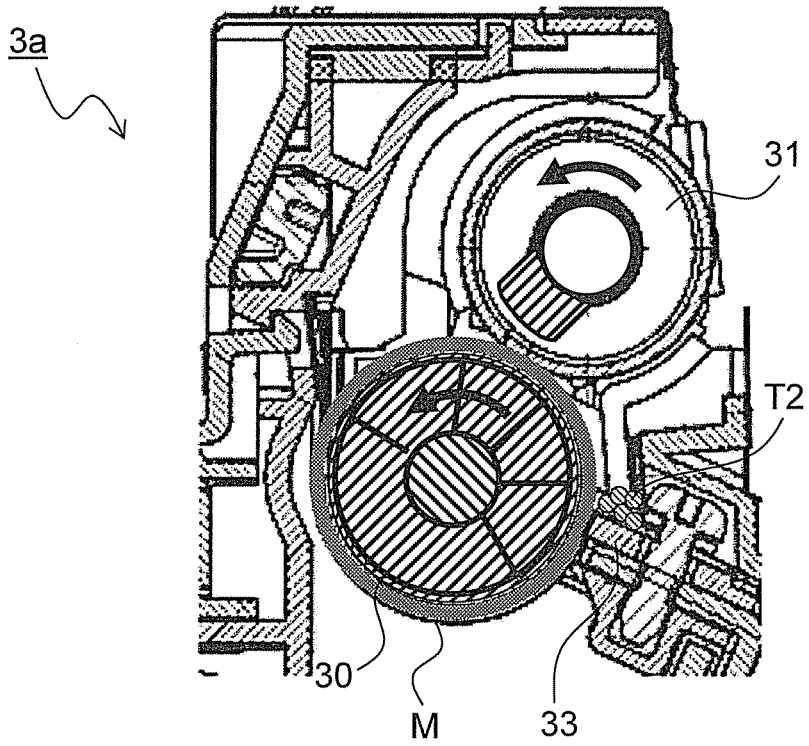
FIG. 5 is a partially enlarged view of the development device 3*a* showing a state where the magnetic roller 30 and the development roller 31 are driven in a first positive rotation step of the toner collection mode.

FIG. 5 shows a state where the magnetic roller 30 and the development roller 31 are driven in the first positive rotation step, and the toner layer T1 formed on the development roller 31 is scrubbed by the magnetic brush M of the magnetic roller 30. Then, in a state where the toner layer T1 on the development roller 31 is not present, the rotation of the magnetic roller 30 and the development roller 31 is stopped, and the application of the first bias and the second bias is stopped.

The first positive rotation step is performed, the rotation of the magnetic roller 30 and the development roller 31 and the application of the first bias and the second bias are stopped and thereafter the reverse rotation step is performed. In the reverse rotation step, in a state where the first bias and the second bias for forming the toner layer T1 on the development roller 31 are applied, the magnetic roller 30 and the development roller 31 are rotated reversely. Specifically, the first bias of the first voltage application portion 55 is set at a higher voltage on the same polarity side (the positive side) as the toner than the second bias of the second voltage application portion 56. Then, the control portion 60 sends the reverse direction signal to the drive circuit 70, and the drum motor 80 and the development motor 81 are rotated reversely by the reverse rotation signal. The rotation of the photosensitive drum la is stopped by the one-way clutch, and the magnetic roller 30 and the development roller 31 are rotated by the development motor 81 in the reverse direction (clockwise direction).

Figure 6:
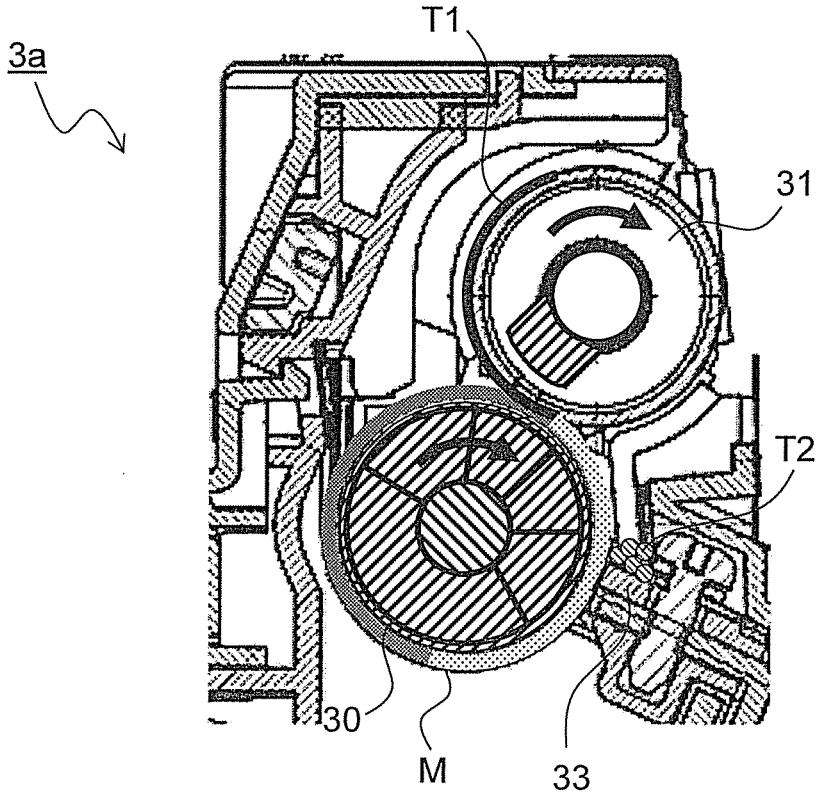
FIG. 6 is a partially enlarged view of the development device 3*a* showing a state where the magnetic roller 30 and the development roller 31 are driven in a reverse rotation step of the toner collection mode.

FIG. 6 shows a state where the magnetic roller 30 and the development roller 31 are driven in the reverse rotation step, and the toner layer T1 is formed on the development roller 31, and thus the toner in the magnetic brush M formed on the magnetic roller 30 is moved to the development roller 31, with the result that the toner concentration in the magnetic brush M is lowered (a portion of FIG. 6 that is lightly hatched). Then, the magnetic brush M where the toner concentration is lowered passes the restriction blade 33 while being in contact with the restriction blade 33, and thus it is possible to effectively scrub a deposit toner T2 dropped in the vicinity of the restriction blade 33. The deposit toner T2 scrubbed by the magnetic brush M is pulled off from the magnetic roller 30 by the portion of the stationary magnet member having the same polarity (separation pole), and is collected within the supply transport chamber 22.

Preferably, in the reverse rotation step, the drive circuit 70 varies the width of the pulse voltage applied to the development motor 81 to vary the rotation speed of the development motor 81, and thus the magnetic roller 30 is rotated reversely at a rotation speed lower than in the print mode. In this way, the deposit toner T2 in the vicinity of the restriction blade 33 is gently scrubbed by the magnetic brush M, and thus it is possible to reduce the scattering of the toner around the restriction blade 33 when the reverse rotation step is performed.

In the present embodiment, in the reverse rotation step, the development motor 81 is controlled such that the magnetic roller 30 is reversely rotated one or more revolutions. In this way, the deposit toner T2 in the vicinity of the restriction blade 33 is reliably collected to the supply transport chamber 22.

The reverse rotation step is performed, the rotation of the magnetic roller 30 and the development roller 31 and the application of the first bias and the second bias are stopped and thereafter the second positive rotation step is performed. In the second positive rotation step, in a state where the first bias and the second bias for scrubbing the toner layer T1 on the development roller 31 are applied, the magnetic roller 30 and the development roller 31 are rotated positively. Specifically, the second bias of the second voltage application portion 56 is set at a higher voltage on the same polarity side (the positive side) as the toner than the first bias of the first voltage application portion 55. Then, the control portion 60 sends the positive direction signal to the drive circuit 70, and the drum motor 80 and the development motor 81 are rotated positively by the positive rotation signal.

Figure 7:
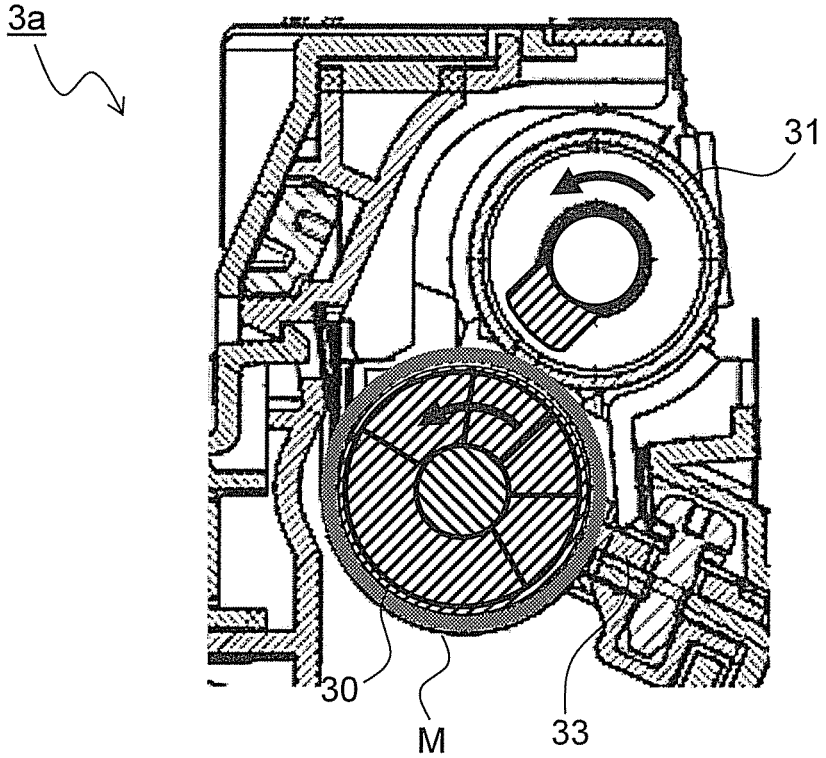
FIG. 7 is a partially enlarged view of the development device 3*a* showing a state where the magnetic roller 30 and the development roller 31 are driven in a second positive rotation step of the toner collection mode.

FIG. 7 shows a state where the magnetic roller 30 and the development roller 31 are driven in the second positive rotation step, and the toner layer T1 formed on the development roller 31 is scrubbed by the magnetic brush M of the magnetic roller 30. Then, in a state where the toner layer T1 on the development roller 31 is not present, the rotation of the magnetic roller 30 and the development roller 31 is stopped, and the application of the first bias and the second bias is also stopped.

As described above, in the present embodiment, the first positive rotation step and the reverse rotation step are sequentially performed, and thus in the reverse rotation step, the toner concentration in the magnetic brush M (developer) formed on the magnetic roller 30 is lowered than in the print mode. In this way, the function of scrubbing the toner by the magnetic brush M is enhanced. Thus, it is possible to rapidly and reliably collect the deposit toner T2 on the restriction blade 33.

In the present embodiment, after the reverse rotation step is performed, the second positive rotation step is performed to scrub the toner layer T1 on the development roller 31. In this way, since a new toner layer T1 is constantly formed in the subsequent round of image formation, it is possible to enhance the image quality in the subsequent round of image formation. There is no possibility that after the toner collection mode is performed, when the toner layer T1 on the development roller 31 is left for a long period of time, the toner layer T1 is fixed and adhered.

When the first positive rotation step, the reverse rotation step and the second positive rotation step described above are performed, the second bias of the second voltage application portion 56 is set lower than a charge bias applied by the charging device 2*a* (see FIG. 1) to the photosensitive drum 1*a*, and thus it is possible to prevent the movement of the toner to the photosensitive drum 1*a*. Hence, it is not necessary to perform a cleaning operation before the subsequent round of image formation, with the result that it is possible to rapidly perform image formation.

The present disclosure is not limited to the embodiment described above, and various modifications are possible without departing from the spirit of the present disclosure. For example, although in the embodiment described above, the toner collection mode in which the first positive rotation step, the reverse rotation step and the second positive rotation step are sequentially performed has been described, the toner collection mode can be made a toner collection mode in which only the first positive rotation step and the reverse rotation step are performed without the second positive rotation step being performed.

In the embodiment described above, between the first positive rotation step and the reverse rotation step and between the reverse rotation step and the second positive rotation step, the rotation of the magnetic roller 30 and the development roller 31 and the application of the first bias and the second bias are stopped. This is because since the rotation direction of the magnetic roller 30 and the development roller 31 is suddenly switched, and thus the loads of the gear and the motor for driving the magnetic roller 30 and the development roller 31 are increased, a stop time is provided in order to reduce the loads of the gear and the motor; this is not a necessary constituent requirement for practicing the present disclosure.

Although in the embodiment described above, as the image forming apparatus of the present disclosure, as shown in FIG. 1, the tandem-type color printer 100 of an intermediate transfer method in which a full color image formed by sequentially stacking the toner images of the individual colors on the intermediate transfer belt 8 that is an example of the intermediate transfer member is transferred onto the sheet P at one time has been described, the present disclosure can be applied, in complexly the same manner, to a tandem-type color printer of a direct transfer method in which the toner images of the individual colors are sequentially transferred onto the sheet P carried and transported on a transfer belt, a monochrome printer, a monochrome copying machine and a digital copying machine.

The present disclosure can be utilized for an image forming apparatus that includes a development device which uses a two-component developer formed with a toner and a magnetic carrier and which carries only the toner on a toner carrying member to develop an electrostatic latent image on a photosensitive member. By utilization of the present disclosure, it is possible to provide an image forming apparatus that can effectively collect a toner which is not supplied to an image carrying member and which is deposited around a restriction member.

What is claimed is:

1. An image forming apparatus comprising:

an image carrying member on which an electrostatic latent image is formed;

a development device which includes, a developer carrying member, which incorporates a magnet, carries a two-component developer containing a toner and a magnetic carrier on a surface of the developer carrying member, forms a magnetic brush on the surface of the developer carrying member from the magnetic carrier, and transports the magnetic brush by rotation, a toner carrying member that is arranged opposite the image carrying member and the developer carrying member, that carries, on a surface of the toner carrying member, the toner in the magnetic brush transported by the rotation of the developer carrying member and that supplies the carried toner to the image carrying member and a restriction member that is arranged a predetermined distance apart from the developer carrying member below the toner carrying member and that restricts a thickness of a layer of the developer on the surface of the developer carrying member and the electrostatic latent image formed on the image carrying member is developed into a toner image;

a first voltage application portion which applies a first bias to the developer carrying member;

a second voltage application portion which applies a second bias to the toner carrying member; and a control portion which controls voltages of the first voltage application portion and the second voltage application portion and drives motors to rotate the developer carrying member and the toner carrying member, wherein the control portion performs, at a time of no image formation, a toner collection mode that includes a first positive rotation step in which in a state where the second bias is set at a higher voltage on a same polarity side as the toner than the first bias, the developer carrying member and the toner carrying member are rotated in a same direction as a direction at a time of image formation and a reverse rotation step in which after the first positive rotation step is performed, in a state where the first bias is set at a higher voltage on the same polarity side as the toner than the second bias, the developer carrying member and the toner carrying member are rotated in a direction reverse to the direction at the time of image formation.

2. The image forming apparatus of claim 1, wherein the control portion performs a second positive rotation step in which after the reverse rotation step is performed, in a state where the second bias is set at a higher voltage on the same polarity side as the toner than the first bias, the developer carrying member and the toner carrying member are rotated in the same direction as the direction at the time of image formation.

3. The image forming apparatus of claim 1, wherein the control portion stops, between the first positive rotation step and the reverse rotation step, the rotations of the developer carrying member and the toner carrying member and the applications of the first bias and the second bias.

4. The image forming apparatus of claim 2, wherein the control portion stops, between the reverse rotation step and the second positive rotation step, the rotations of the developer carrying member and the toner carrying member and the applications of the first bias and the second bias.

5. The image forming apparatus of claim 1, wherein the control portion performs the toner collection mode in a state where the second bias is set at a lower voltage on the same polarity side as the toner than a bias applied to the image carrying member.

6. The image forming apparatus of claim 1, wherein in the reverse rotation step, the control portion rotates the developer carrying member at a rotation speed lower than a rotation speed at the time of image formation.

7. The image forming apparatus of claim 1, wherein in the reverse rotation step, the control portion rotates the developer carrying member one or more revolutions.

* * * * *